US006742317B2

(12) United States Patent
Cronauer et al.

(10) Patent No.: US 6,742,317 B2
(45) Date of Patent: Jun. 1, 2004

(54) INDIVIDUAL PACKAGE BAGGER AND PROCESS

(75) Inventors: William M. Cronauer, Tallmadge, OH (US); Bernard Lerner, Aurora, OH (US)

(73) Assignee: Automated Packaging Systems, Inc., Streetsboro, OH (US)

( * ) Notice: Subject to any disclaimer, the term of this patent is extended or adjusted under 35 U.S.C. 154(b) by 0 days.

(21) Appl. No.: 10/342,859

(22) Filed: Jan. 15, 2003

(65) Prior Publication Data

US 2003/0106285 A1 Jun. 12, 2003

Related U.S. Application Data

(62) Division of application No. 10/100,809, filed on Mar. 18, 2002, now Pat. No. 6,543,201.
(60) Provisional application No. 60/318,240, filed on Sep. 7, 2001.

(51) Int. Cl.[7] ..... B65B 61/02
(52) U.S. Cl. ..... 53/411; 53/459; 53/468; 53/469; 53/479; 53/131.5
(58) Field of Search ..... 53/411, 457, 459, 53/467, 468, 469, 473, 476, 477, 479, 131.2, 131.04, 131.5, 384.1, 385.1, 389.2, 389.4, 284.7

(56) References Cited

U.S. PATENT DOCUMENTS

| | | | | |
|---|---|---|---|---|
| 3,254,828 A | | 6/1966 | Lerner | |
| 3,881,410 A | | 5/1975 | Shenoa | |
| 4,899,520 A | | 2/1990 | Lerner et al. | |
| 5,341,625 A | | 8/1994 | Kramer | |
| 5,371,521 A | | 12/1994 | Wehrmann | |
| 5,394,676 A | | 3/1995 | Lerner et al. | |
| 5,468,080 A | | 11/1995 | Jones | |
| 5,499,485 A | * | 3/1996 | Lerner et al. | 53/459 |
| 5,568,718 A | * | 10/1996 | Lerner et al. | 53/479 |
| 5,570,568 A | * | 11/1996 | Kramer | 53/479 |
| 5,600,360 A | | 2/1997 | Lerner et al. | |
| 5,640,834 A | * | 6/1997 | Lerner et al. | 53/468 |
| 5,709,069 A | | 1/1998 | Cronauer | |
| 5,846,002 A | | 12/1998 | Buckby et al. | |
| 6,041,574 A | | 3/2000 | Bennett | |
| 6,067,103 A | | 5/2000 | Ewert et al. | |
| 6,142,049 A | | 11/2000 | Schweitzer et al. | |
| 6,199,349 B1 | | 3/2001 | Lerner | |
| 6,363,687 B1 | | 4/2002 | Luciano et al. | |
| 6,470,648 B1 | | 10/2002 | Baker | |
| 6,543,201 B2 | | 4/2003 | Cronauer et al. | |
| 2002/0062920 A1 | | 5/2002 | Braheir et al. | |

* cited by examiner

*Primary Examiner*—John Sipos
*Assistant Examiner*—Louis Huynh
(74) *Attorney, Agent, or Firm*—Watts, Hoffmann, Co., L.P.A.

(57) ABSTRACT

A machine for forming individual packages from a web of preopened and interconnected bags one at a time is disclosed. A web is fed along a path of travel from a supply to a load station. A pair of nip rolls are positioned along the path near the load station. A printer is positioned along the path between the supply and the nip rolls. A nip roll drive is provided for rotating the nip rolls selectively and one at a time at a printing rate for the feed of the web when the printer is operating and at a faster feed rate for positioning a bag at the load station when the printer is not operating. A supply station tensioner is provided for tensioning a web along the path such that the printer when operating prints a section of a tensioned web.

9 Claims, 3 Drawing Sheets

INDIVIDUAL PACKAGE BAGGER AND PROCESS

This is a Divisional application of application Ser. No. 10/100,809, filed on Mar. 18, 2002 now U.S. Pat. No. 6,543,201.

This application claims the benefit of Provisional Application No. 60/318,240 filed Sep. 7, 2001.

This invention relates to packaging machines and more particularly to a packaging machine especially designed for packaging quantities of materials to fill individual orders and the process of filling such orders.

BACKGROUND

Machines that use webs of pre-opened bags to form packages are now well known. Such webs of bags are disclosed and claimed in the U.S. Pat. No. 3,254,828 entitled Flexible Container Strips (the Autobag Patent). A machine which is currently in wide usage commercially for forming packages from chains of pre-opened bags utilizing a novel web tensioning dancer mechanism is described and claimed in U.S. Pat. No. 5,394,676 issued Mar. 7, 1995 to Bernard Lerner et al. under the titled Packaging Machine and Method (the Excel Patent). Machines made in accordance with the teaching of the Excel Patent often are supplied parts to be packaged by modular systems of counters and/or weighers and conveyors in order that packages can be formed automatically and at relatively high speeds.

The Excel machines are often equipped with printers such as described and claimed in U.S. Pat. No. 5,371,521 issued Dec. 6, 1994 to Rick S. Wehrmann (the Teeter Totter Patent). The machine of the Teeter Totter Patent is designed to print identical information on each bag in a chain of interconnected bags. The Teeter Totter Patent is directed to a mechanism which tensions the chain of bags and feeds it past a print head in a printing section of a chain of bags. The printing section is tension isolated from a supply section which supplies the chain and also from a downstream section which delivers bags to a load station such that the three sections are independently tensioned.

The Excel Patent teaches a dancer mechanism which independently tensions the supply section upstream from the printer section while a conveyor system effects tensioning of the downstream section. These mechanisms produce the three isolated, individually tensioned sections along the feed path of an Excel machine.

Relatively large "mail order" and "e-business" organizations require systems for filling individual orders. An example is organizations which fill individual orders for pharmaceuticals. Such pharmaceutical organizations typically utilize so called wicketed bags for packaging individual orders for shipment offsite to customers. Pressure sensitive labels are used to identify the contents of each bag and to provide an address for shipment of each filled bag to a customer at an offsite location. The wicketed bag approach is slow and expensive. For pharmaceutical shipment it is especially expensive in that only registered pharmacists can fill individual bags with pharmaceutical orders so that each load station must have an assigned pharmacist.

A machine which is a modified version of a packaging machine competitive with the Excel machine is currently being offered for sale. This modified machine has what has been characterized as a ditch to receive and accumulate each bag in an untensioned loop after it has been printed but before it is fed to a load station. This results in printing errors and wrinkling of bags such that finished packages are not as attractive as they should be and lost shipments can result from printing errors.

Accordingly it would be desirable to provide a machine which uses a web of pre-opened bags for packaging individual orders and which prints identifying information on an upstream tensioned bag as a previously printed bag is loaded with its appropriate batch of pharmaceuticals and sealed.

SUMMARY OF THE INVENTION

DETAILED DESCRIPTION OF THE PREFERRED EMBODIMENT

Figure 1:
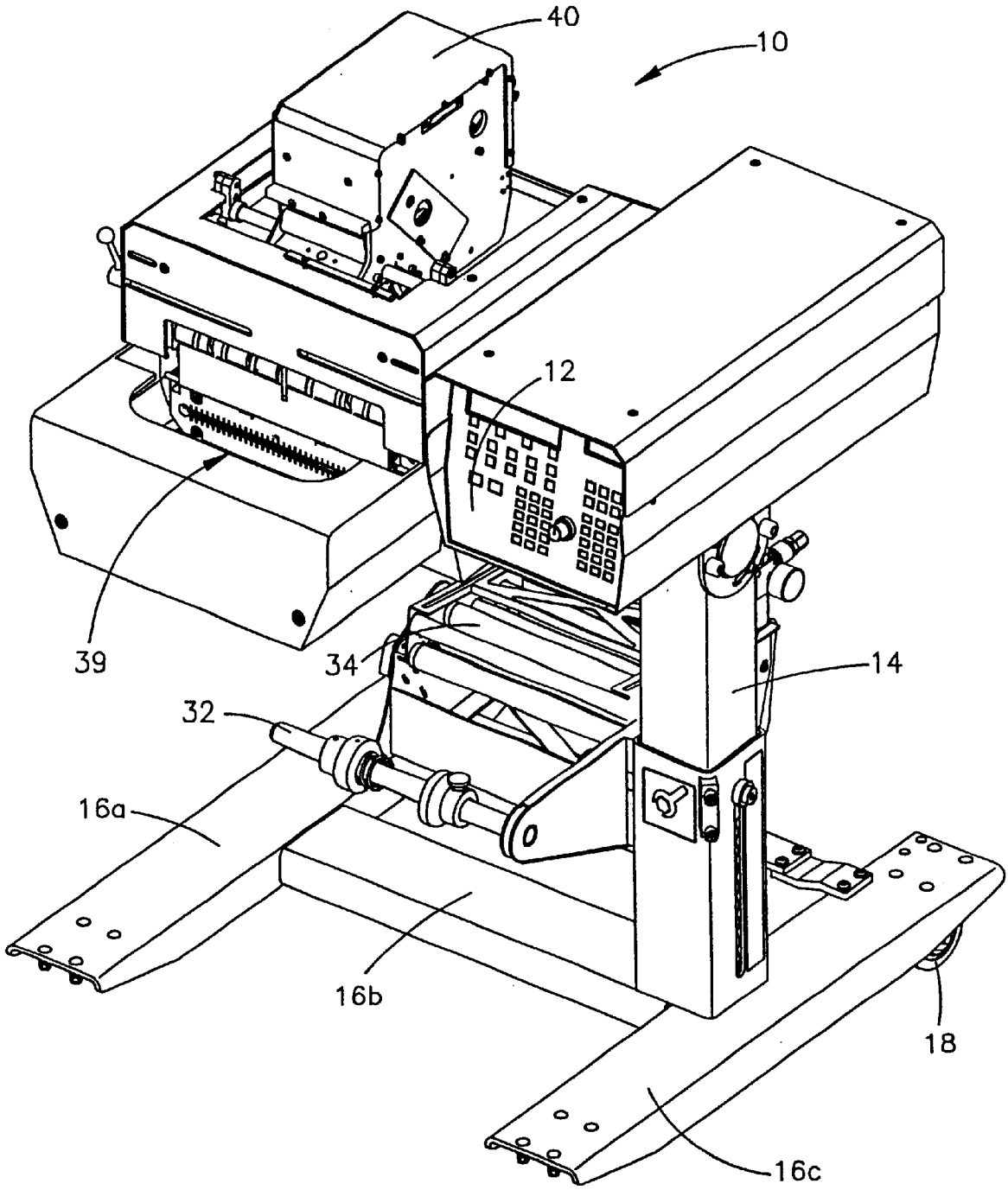
FIG. 1 is a perspective view of a bagging machine of the type disclosed and claimed in the Excel patent and modified in accordance with the present invention.

Turning now to the drawings and FIG. 1 in particular, a bagging machine is shown generally at 10. A machine control 12 is connected to the bagger 10. The bagger and the control are mounted on a post 14 which in turn is mounted on a wheeled base 16 to support the bagger and control cantilever fashion over the base. The base includes two wheeled side arms 16*a*, 16*c* connected by a cross member 16*b*. Four wheels 18 are provided to facilitate movement of assembly to desired locations.

Figure 2:
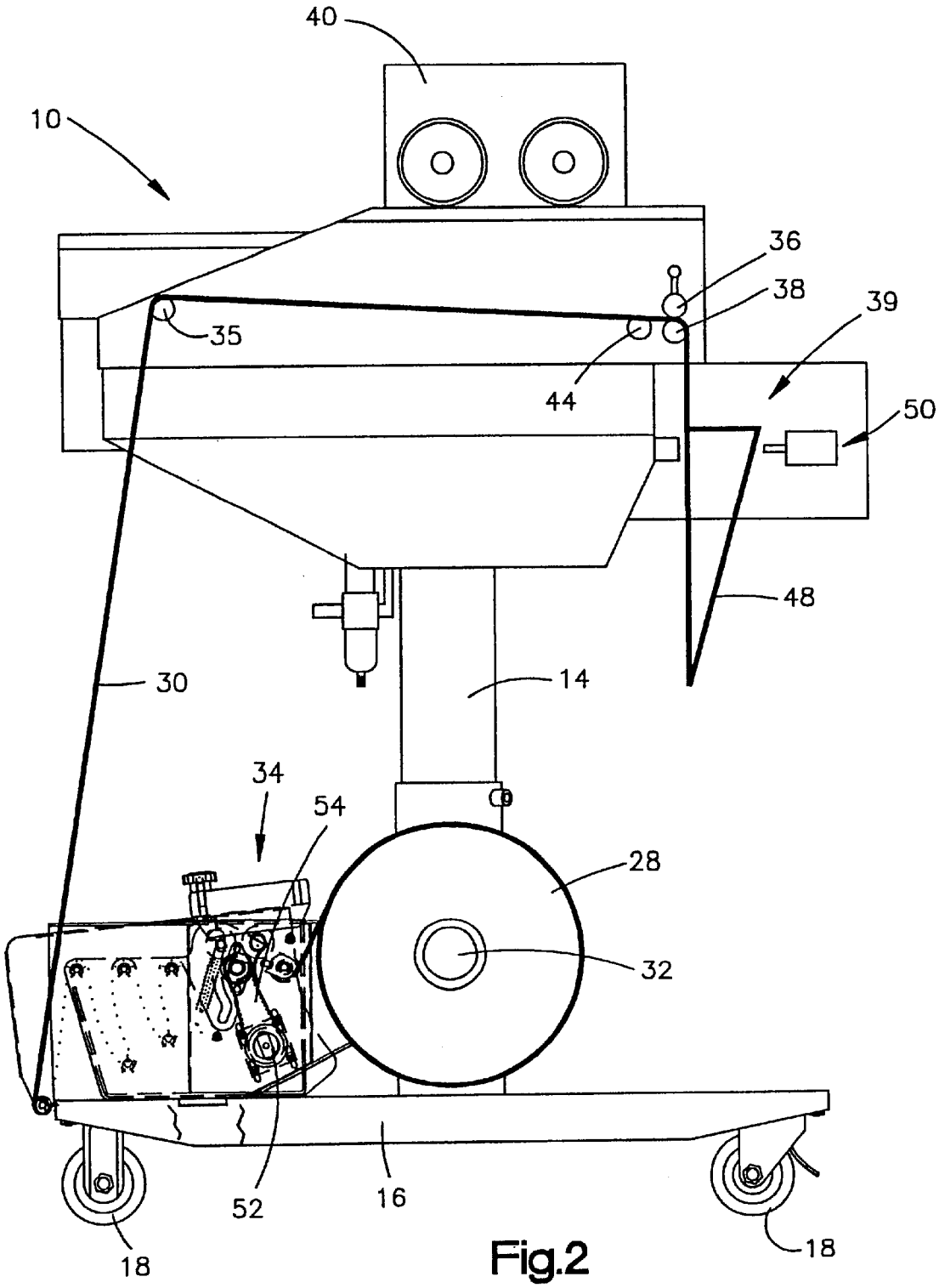
FIG. 2 is a somewhat schematic view of the machine of FIG. 1 showing the web feed path through the machine; and, FIG. 3 is a view showing the printer, the printhead and its coaction with web feed and support rolls.
Figure 3:
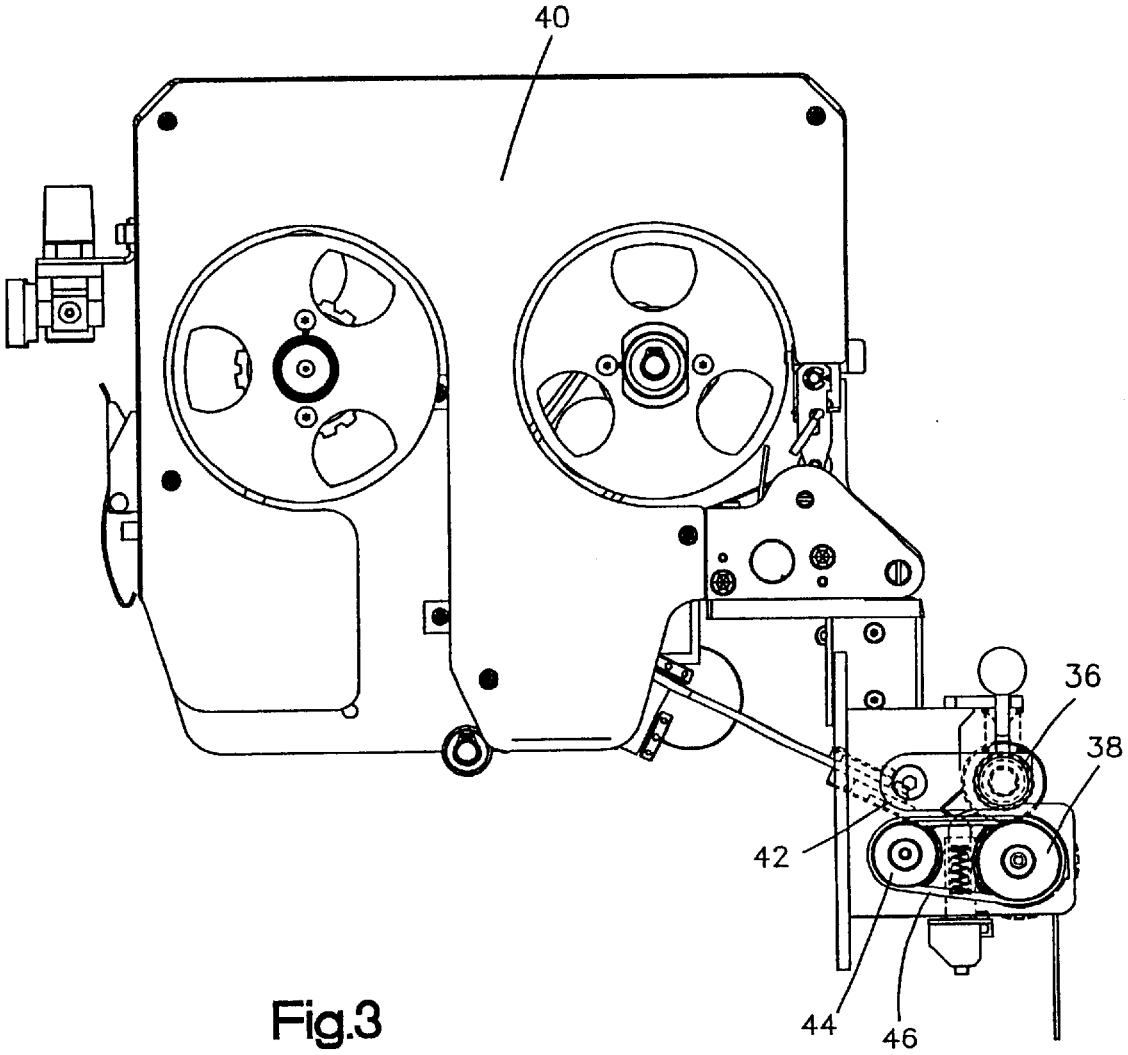

As shown schematically in FIG. 2, a roll 28 of an elongate web bags is mounted on the post 14 by a mandrel 32. The roll 28 is a wound web 30 of preopened bags of the type sold commercially under the trademark Autobag by the Assignee of this patent.

The web 30 is fed from the supply roll 28 through a servo dancer mechanism 34. The web is fed upwardly from the dancer mechanism over a guide roll 35 toward the rear of the bagger 10 and thence forwardly through a pair of nip rolls 36, 38 to a load station 39.

A printer 40 is provided. The printer includes a print head 42 which coacts with a print roll 44. The print roll 44 is drivingly connected to the nip roll 38 by a belt 46. The belt 38 engages the rolls in respective grooves which are sized such that the rolls 38, 44 rotate with the same surface speed. Like surface speeds of the rolls avoids wrinkling of the web as is fed forward and backward between the nip rolls 36, 38.

Operation

In operation the nip rolls 36 are counter rotated to feed the web 30 until a previously printed end bag 48 is positioned at the load station 22, FIG. 2. After a product has been inserted into the end bag, a seal mechanism shown schematically at 50 is closed. The seal mechanism is that described and claimed in the Excel patent. While the end bag is being sealed the nip rolls are counter rotated to reverse feed the web and separate the end bag 48 from the web. If the next bag requires a substantial amount of printing, the reverse feeding is continued until the print head 42 is positioned at a desired relative position along the next bag for effecting printing of information. Typical information will include identification of the items to be packaged and the name and address of the intended recipient of the packages.

As the web 30 is reverse fed for bag separation and positioning of the next bag for printing, tension is maintained on the web by the dancer mechanism 34. To this end a stepper motor 52 of the dancer mechanism reverses the rotation of dancer feed rolls 54, FIG. 2 to maintain constant web tension all in a matter fully described in the Excel patent. Once printing commences the nip and print rolls are rotated relatively slowly to advance the web as it is printed. After the printing has concluded and the end bag has been dicharged from the sealer, the rolls are rotated at a faster speed to quickly deliver the newly printed bag to the load station and advance a further bag to the print station. Electronic controls for the operation of the machines are described more fully in U.S. Pat. No. 5,341,625 entitled Bagging Control Apparatus and Method Issued Aug. 30, 1994 and in the copending concurrently filed application attorney docket 16-014.

Although the invention has been described in its preferred form with a certain degree of particularity, it is understood that the present disclosure of the preferred form has been made only by way of example and that numerous changes in the details of construction, operation and the combination and arrangement of parts may be resorted to without departing from the spirit and the scope of the invention as hereinafter claimed.

What is claimed is:

1. A process of packaging products to fill individual orders comprising:

a) feeding a web of interconnected preopened bags along a path of travel from a supply to and through nip rolls to a load station and whereat the bags are successively filled and closed to fill orders;

b) forming a package by inserting a product into an opened bag at the load station to fill an order;

c) tensioning a web section between an upstream dancer mechanism and the nip rolls, the dancer mechanism being proximate the supply; and, d) while the package being formed is at the load station imprinting an end bag adjacent the nip rolls in the tensioned web section with at least a portion of identifying information for another order, said another order being the next order to be filled and the end bag having been connected to the opened bag.

2. The process of claim 1 wherein the tensioned section is reverse fed along the path prior to the imprinting step.

3. The process of claim 1, wherein the web section is reverse fed along the path prior to the imprinting step.

4. The process of claim 1, wherein the product is a pharmaceutical.

5. A process of packaging individual discrete orders comprising:

a) feeding a web of interconnected pre-opened bags along a path of travel from a supply then through a dancer thence to and through a printing station to a load station;

b) using the dancer to tension a section of the web in the printing station;

c) printing identifying indicia for a specific order on a bag included in the section and positioned in the printing station;

d) further feeding the web to position the printed bag at the load station and a further bag at the printing station, the further bag being directly connected and adjacent to the printed bag;

e) opening the printed bag and filling it with contents required for the specific order while the printed bag is at the load station;

f) closing the printed and filled bag and separating it from the further bag and the web;

g) printing the further bag concurrently with at least a portion of the performance of the opening, filling, closing and separating steps on the printed bag; and, h) repeating steps d through g to fill, close and separate the further bag and to print, fill, close and separate still further bags.

6. The process of claim 5 wherein the bag separation step including reverse feeding the web by driving web feeding nip rolls in a reverse direction while the dancer reverses movement of the tensioned section along the path of travel to absorbs slack in the web and maintain web tension in the section.

7. The process of claim 6 wherein the reverse feeding is to an extent needed to provide adequate bag surface area for printing the bag then at the printing station.

8. The process of claim 7 wherein the reverse feeding is also effective to separate a filled and closed bag at the load station from the web.

9. The process of claim 5 wherein the bag separation step includes reverse feeding the web by driving web feeding nip rolls in a reverse direction while the dancer absorbs slack in the web to maintain web tension in the section, the reversal serving to effect separation of a loaded bag from the web.

* * * * *